US008565450B2

(12) United States Patent
Dronge et al.

(10) Patent No.: US 8,565,450 B2
(45) Date of Patent: Oct. 22, 2013

(54) MUSICAL INSTRUMENT EFFECTS PROCESSOR

(75) Inventors: Mark Dronge, Tenafly, NJ (US); David Anthony Amels, Woodridge, NJ (US)

(73) Assignee: Mark Dronge, Tenafly, NJ (US)

( * ) Notice: Subject to any disclaimer, the term of this patent is extended or adjusted under 35 U.S.C. 154(b) by 1553 days.

(21) Appl. No.: 12/008,748

(22) Filed: Jan. 14, 2008

(65) Prior Publication Data

US 2009/0180634 A1 Jul. 16, 2009

(51) Int. Cl.
*G10H 1/00* (2006.01)

(52) U.S. Cl.
USPC ..... 381/118; 381/120

(58) Field of Classification Search
USPC ..... 381/118
See application file for complete search history.

(56) References Cited

U.S. PATENT DOCUMENTS 4,237,764 A * 12/1980 Suzuki ..... 84/704
4,885,792 A * 12/1989 Christensen et al. ..... 381/119
5,633,993 A * 5/1997 Redmann et al. ..... 345/419
5,883,325 A 3/1999 Peirce
5,905,223 A 5/1999 Goldstein
6,162,983 A 12/2000 Takahashi
6,881,891 B1 * 4/2005 Limacher et al. ..... 84/662
6,931,134 B1 * 8/2005 Waller et al. ..... 381/27
6,998,528 B1 * 2/2006 Limacher et al. ..... 84/662
2002/0065568 A1 * 5/2002 Silfvast et al. ..... 700/94
2003/0035559 A1 * 2/2003 Cohen ..... 381/119
2004/0016338 A1 * 1/2004 Dobies ..... 84/662
2004/0049791 A1 * 3/2004 Shah et al. ..... 725/82
2004/0159222 A1 * 8/2004 Pennock et al. ..... 84/662
2004/0182230 A1 * 9/2004 Vlant et al. ..... 84/662
2005/0027888 A1 * 2/2005 Juszkiewicz ..... 709/250
2006/0054004 A1 * 3/2006 Funaki ..... 84/600
2006/0147050 A1 * 7/2006 Geisler ..... 381/61
2007/0095195 A1 * 5/2007 Pango et al. ..... 84/602
2007/0121977 A1 * 5/2007 Mitchler ..... 381/314
2007/0131100 A1 * 6/2007 Daniel ..... 84/737
2007/0169615 A1 * 7/2007 Chidlaw et al. ..... 84/723
2009/0100988 A1 * 4/2009 Villa et al. ..... 84/601
2009/0151542 A1 * 6/2009 Gain et al. ..... 84/603

OTHER PUBLICATIONS

International Search Report for International Application No. PCT/US2009/000194, May 28, 2009.
Written Opinion for International Application No. PCT/US2009/000194, May 28, 2009.

* cited by examiner

*Primary Examiner* — Robert J Hoffberg
*Assistant Examiner* — Igwe U Anya
(74) *Attorney, Agent, or Firm* — Brian Roffe

(57) ABSTRACT

Arrangement and method for controlling the order and selection of audio effect components using of a user-controlled crosspoint switch device. A user interface controls a processor which in turn controls the crosspoint device to set a plurality of switches forming a matrix therein, thereby allowing arbitrary control over the order and selection of audio effect components, such as pedals, connected to the matrix. The user interface enables both the pre-programming of the desired effect orders and selections as well as selection of preset stored in a memory component in real-time.

20 Claims, 2 Drawing Sheets

MUSICAL INSTRUMENT EFFECTS PROCESSOR

FIELD OF THE INVENTION

The invention relates generally to the field of audio electronics and more specifically to an arrangement and method for enabling variations in the audio effects capable of being applied by audio effect components to audio output from an electronic musical instrument such as an electronic guitar.

BACKGROUND OF THE INVENTION

When playing an electronic musical instrument, such as an electronic guitar, pedals are often used to enable variations in the audio effects generated by the instrument. Each pedal is typically situated in the audio path from the instrument to an amplifier and effects a specific modification of the audio being generated by the instrument, the modification being determined by the construction and setting of the pedal.

A significant drawback of such pedals is that when multiple pedals are used, they must be placed in a specific order and sequentially connected together. The order in which the pedals are placed determines the order in which the audio effects are applied and the order of application of the audio effects significantly affects the audio sounds being output from the amplifier.

The order of the pedals cannot be easily changed while playing the instrument due to the necessity of unplugging and re-plugging audio cables interconnecting the instrument, the pedals and the amplifier. As such, during a live performance, a guitarist cannot readily stop the performance to re-arrange the pedals in order to provide a different audio effect.

It is therefore desirable to provide a player of an electronic guitar or other electronic musical instrument with the ability to easily vary the effects provided by pedals or other audio effect components.

OBJECTS AND SUMMARY OF THE INVENTION

It is an object of the present invention to provide an arrangement and method for enabling audio effects provided by audio effect components to be easily varied, and a computer program which facilitates the variations of the application of audio effect components.

In order to achieve this object and others, an arrangement for controlling application of audio effect components in an audio path from a musical instrument to an audio output component in accordance with the invention includes a crosspoint switch device having an audio input connection adapted to be coupled to the instrument, an audio output connection adapted to be coupled to the audio output component, a plurality of effect input connections and a plurality of effect output connections. Each audio effect component has its input coupled to a respective effect input connection and its output coupled to a respective effect output connection. The crosspoint switch device enables connection of each effect input connection to the audio input connection and all of the effect output connections, and each effect output connection to the audio output connection, as well as a connection between the audio input connection and the audio output connection which would be used if no audio effect components are to be used. A control unit controls the connections between the audio input connection, the audio output connection, the effect input connections and the effect output connections to enable variations in the audio path from the audio input connection to the audio output connection via the audio effect components. For example, the control unit can control the connections to enable variations in the number and order of the audio effect components being interposed in the audio path between the audio input connection and the audio output connection.

In one embodiment, the control unit includes a processor, a memory component coupled to the processor and a user interface coupled to the processor and arranged to enable creation of programs for controlling the connections between the audio input connection, the audio output connection, the effect input connections and the effect output connections. The created programs may be stored in the memory component and operatively run by the processor. Additionally or alternatively, the control unit includes an external network connection coupled to the processor to enable control of the processor from a remote location by a remote device which is also coupled to the external network.

A related arrangement for controlling audio output from an electronic musical instrument in accordance with the invention includes the crosspoint switch device as described above, a plurality of audio effect components, each having an input coupled to a respective effect input connection and an output coupled to a respective effect output connection. As such, the control unit controls the connections between the audio input connection, the audio output connection, the effect input connections and the effect output connections to enable variations in then audio path from the audio input connection to the audio output connection via the audio effect components. The audio effect components may be pedals.

A method for controlling application of audio effect components in an audio path from a musical instrument to an audio output component in accordance with the invention includes providing a crosspoint switch device as described above, coupling the audio input connection to the instrument, coupling the audio output connection to the audio output component, arranging the crosspoint switch device to enable connection of each effect input connections to the audio input connection and each effect output connection, and also enabling connection of each effect output connection to the audio output connection, and controlling the connections between the audio input connection, the audio output connection, the effect input connections and the effect output connections to enable variations in an audio path from the audio input connection to the audio output connection via the audio effect components.

In one embodiment, programs for controlling the connections between the audio input connection, the audio output connection, the effect input connections and the effect output connections are created, stored and operatively run.

As such, the present invention also includes a computer program resident on computer-readable media and arranged to control application of audio effect components in an audio path from a musical instrument to an audio output component. The computer program is arranged to enable determination of a number and order of audio effect components to interpose in the audio path and control connections of a crosspoint switch device as described above.

Other and further objects, advantages and features of the present invention will be understood by reference to the following specification in conjunction with the annexed drawings, wherein like parts have been given like numbers.

BRIEF DESCRIPTION OF THE DRAWINGS

The invention, together with further objects and advantages thereof, may best be understood by reference to the following description taken in conjunction with the accompanying drawings wherein like reference numerals identify like elements.

DETAILED DESCRIPTION OF THE INVENTION

Figure 1:
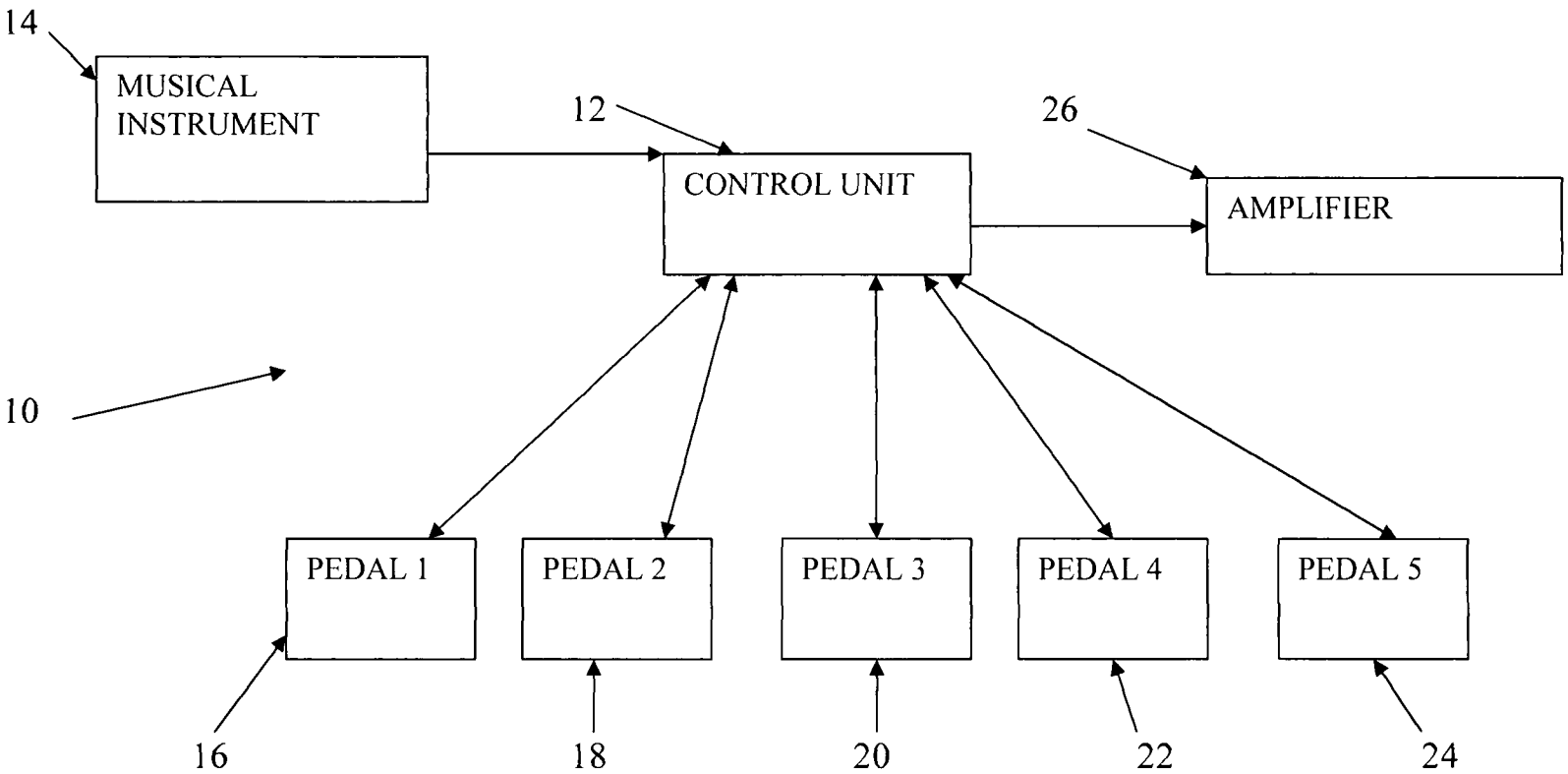
FIG. 1 is a schematic of the primary components of an arrangement in accordance with the invention which can be used in a method in accordance with the invention.

Referring to the accompanying drawings wherein like reference numerals refer to the same or similar elements, FIG. 1 is a schematic of an arrangement in accordance with the invention which is designated generally as 10 and includes a control unit 12 which enables selective and variable application of audio effects to audio originating from an electronic musical instrument 14 by means of a plurality of pedals 16, 18, 20, 22, 24. The pedals 16, 18, 20, 22, 24 are selectively interposed in the audio path between the musical instrument 14 and an amplifier or other audio output component 26.

Figure 2:
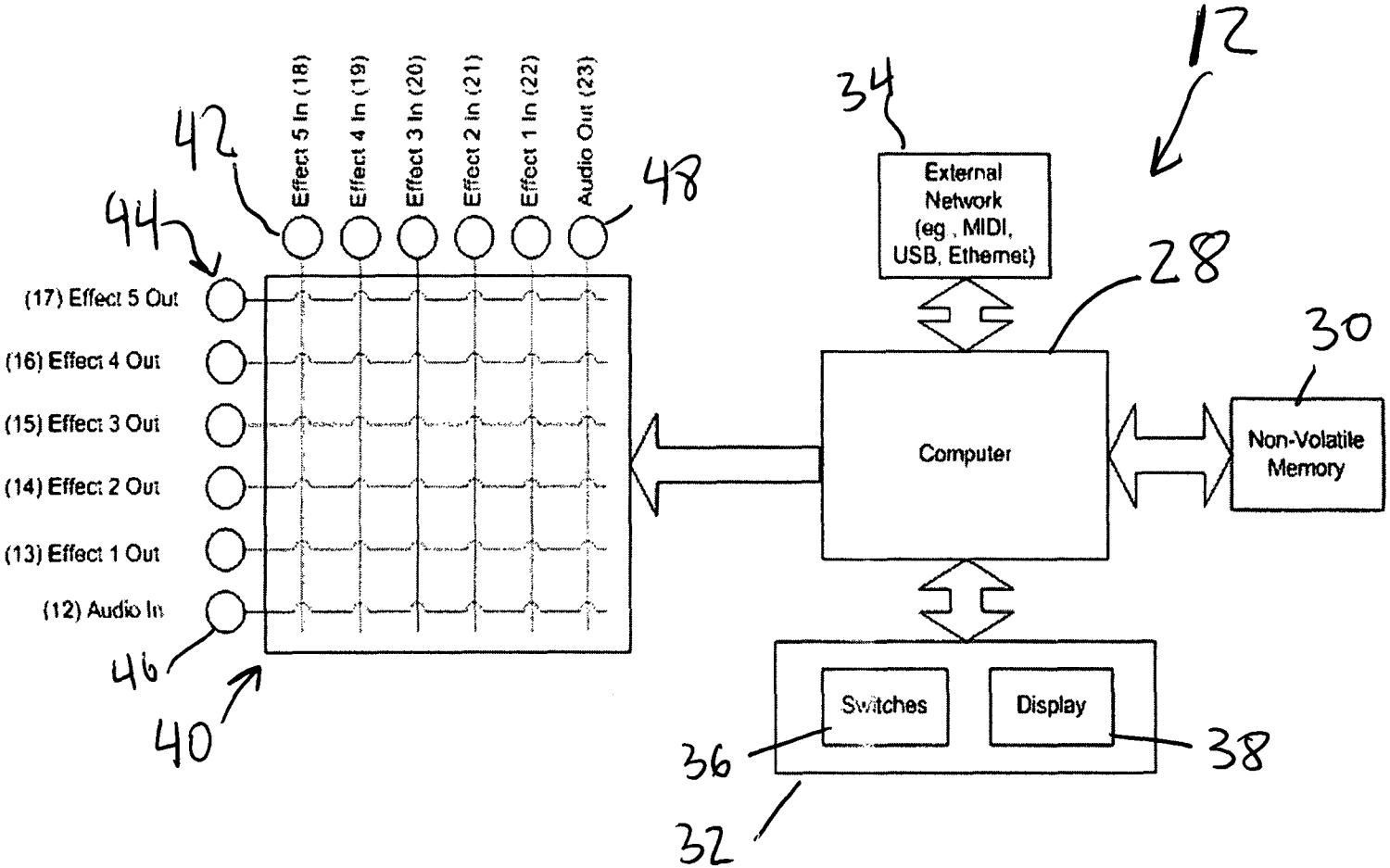
FIG. 2 is a block diagram representation of a control unit for the arrangement in accordance with the invention.

Although FIG. 1, as well as FIG. 2, relate to an embodiment of the arrangement 10 wherein there are five pedals 16, 18, 20, 22, 24, any number of pedals may be provided. Each pedal is connected to the control unit 12 in a manner described below.

Generally, the control unit 12 is controlled (manually or automatically via a program) to determine an order in which the pedals 16, 18, 20, 22, 24 modify the input audio and after modification by one or more of the pedals 16, 18, 20, 22, 24, the modified audio is output to the amplifier 26 or other audio output component. Although components 16, 18, 20, 22, 24 are identified as pedals, it should be understood that pedals are used as an example of an audio effect component or modifier and any and all current or future audio effect modifiers or other components which act upon an audio input to change it are contemplated to be within the scope and spirit of the invention.

Control unit 12 is designed to enable the order in which the pedals 16, 18, 20, 22, 24 modify the input audio and provide a modified output audio to be easily varied as desired. For example, at one time, control unit 12 may be arranged to apply only one of the pedals, while at others, two or more of the pedals. Control unit 12 may also be arranged to apply a plurality of the pedals, say four, in one order for a certain amount of time, and then apply the same four pedals in a different order for a different amount of time.

FIG. 2 shows a block diagram of an exemplifying control unit 12 which enables variable and real-time selection and ordering of the pedals 16, 18, 20, 22, 24 in the audio path between the electronic musical instrument 14 and the amplifier or other audio processing component 26. Control unit 12 includes a computer, microprocessor or other processor 28 coupled to a memory component 30, a user interface 32 and means to connect the processor 28 to an external network 34. Memory component 30 may be non-volatile memory.

User interface 32 may include manual control devices, such as switches 36, a keyboard, mouse or other input devices, and one or more display devices 38. User interface 32 enables programming of routines, i.e., creation of preset routines or programs, for varying the number and order of the application of the pedals 16, 18, 20, 22, 24, which routines are then stored in the non-volatile memory component 30, and enable operational selection of any one of the preset routines.

Control unit 12 also includes a digitally controlled crosspoint switch device 40 having a plurality of effect input ports or connections 42 and a plurality of effect output ports or connections 44. The number of effect input connections and effect output connections should be the same because the input of each pedal 16, 18, 20, 22, 24 is connected to a respective one of the effect input connections 42 and the output of each pedal 16, 18, 20, 22, 24 is connected to a respective one of the effect output connections 44. Similarly, the output from the musical instrument 14 is connected to an audio input connection 46 and the input of the amplifier 26 is connected to an output audio connection 48.

The crosspoint switch device 40 includes a matrix of switches to enable the selective connection of the effect input connections 42 and output audio connection 48 on one side with each of the effect output connections 44 and input audio connection 46 on another side. The crosspoint switch device 40 is then controlled to selectively close specific ones of the switches in the matrix to create a path through the crosspoint switch device 40 for audio starting at the audio input connection 46 and ending at the audio output connection 48, and passing through one or more of the pedals 16, 18, 20, 22, 24 connected to the effect input and output connections 42, 44.

Processor 28 is programmed to provide a "Program Mode" in which the switches 36 of the user interface 32 enable selection of which pedals 16, 18, 20, 22, 24, if any, to interpose in the audio path between the audio input connection 46 and the audio output connection 48 of the crosspoint switch device 40, and importantly, the order in which the selected pedals 16, 18, 20, 22, 24 are to be applied. To this end, processor 28 controls the digitally controlled cross point switch 40. Specifically processor 28 runs software which causes the crosspoint switch device 40 to connect one or more of the effect input connections 42 to a respective one of the effect output connections 44 via closure of specific switches. By design, the crosspoint switch device 40 can connect any effect input connection 42 to any effect output connection 44, thus enabling immediate and real-time selection of audio effects without any requirement of adjusting audio cables.

In practice then, to link pedals 20, 18, 22 in that order, the processor 28 controls the crosspoint switch device 40 to close certain switches and create an audio path from audio input connection 46 to one of the effect input connections 42 leading to pedal 20 (from which the audio is passed through pedal 20 connected thereto), from the effect output connection 44 leading from pedal 20 to one of the effect input connections 42 leading to pedal 18 (from which the audio is passed through pedal 18 connected thereto), from the effect output connection 44 leading from pedal 18 to one of the effect input connections 42 leading to pedal 22 (from which the audio is passed through pedal 22 connected thereto), and from the effect output connection 44 leading from pedal 22 to the audio output connection 48.

If the same three pedals were sought to be used, at a different time during the live performance but in a different order, e.g., 22, 20, 18, then the program created using the user interface 32 and stored in the memory component 30 would be designed to control the crosspoint switch device 40 to creates an audio path from audio input connection 46 to one of the effect input connections 42 leading to pedal 22 (from which the audio is passed through pedal 22 connected thereto), from the effect output connection 44 leading from pedal 22 to one of the effect input connections 42 leading to pedal 20 (from which the audio is passed through pedal 20 connected thereto), from the effect output connection 44 leading from pedal 20 to one of the effect input connections 42 leading to pedal 18 (from which the audio is passed through pedal 18 connected thereto), and from the effect output connection 44 leading from pedal 18 to the audio output connection 48.

User interface 32 is also used for real-time selection of previously stored audio effect orders and selections while the processor 28 is in a "Performance Mode". Previously stored audio effect orders and selections, i.e. the preset routines, may also be recalled or accessed via an external command sent via external network 34 thereby allowing control of the processor 28 from a remote source.

With the foregoing components, arrangement 10 provides a user of guitar or other musical electronic instrument with the capability of having a plurality of audio effect pedals immediately upon command, switched into the audio path in different orders and numbers during a live performance, thereby avoiding the need to physically disconnect and reconnect audio cables. The musician therefore has a significantly larger range of audio effects that can be created from a set number of audio effect pedals in comparison to using the same number of audio effect pedals in a fixed, predetermined order.

One or more computer programs may be arranged in processor 28 to control the crosspoint switch device 40, i.e., control the connections between the effect input connections 42, the effect output connections 44, the audio input connection 46 and the audio output connection 48. The computer program may be created using user interface 32 to selectively vary the order in which the pedals 16, 18, 20, 22, 24 are applied during a musical performance using instrument 14, as well as which pedals are applied. A program could thus be created which applies three pedals in one order for a period of time, then four pedals in one order for another period of time, then the first three pedals in a different order for an additional period of time and then all five pedals in one order for another period of time. The parameters of the program, i.e. the number of pedals to apply the order of pedals to apply and the time for which the number of pedals in the selected order will be applied are all determined by the programmer using the user interface 32.

This program could interact with a remote device via the external network 34 to enable the program to use for a performance to be selected from a remote device connected to the same external network 34.

This computer program may be resident on computer-readable media. Computer-readable medium could be any means that can contain, store, communicate, propagate or transmit a program for use by or in connection with the method, system, apparatus or device. The computer-readable medium can be, but is not limited to (not an exhaustive list), electronic, magnetic, optical, electromagnetic, infrared, or semi-conductor propagation medium. The medium can also be (not an exhaustive list) an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM). The medium can also be paper or other suitable medium upon which a program is printed, as the program can be electronically captured, via for example, optical scanning of the paper or other medium, then compiled, interpreted, or otherwise processed in a suitable manner, if necessary, and then stored in a computer memory. Also, a computer program or data may be transferred to another computer-readable medium by any suitable process such as by scanning the computer-readable medium.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. An arrangement for controlling application of audio effect components in an audio path from a musical instrument to an audio output component, comprising:

a crosspoint switch device having:

an audio input connection adapted to be coupled to the instrument, an audio output connection adapted to be coupled to the audio output component, a plurality of effect input connections; and a plurality of effect output connections, said crosspoint switch device providing a signal path connection between each of said effect input connections and said audio input connection such that signals received by said crosspoint switch device via said audio input connection are selectively directable to one or more of said effect input connections, said crosspoint switch device also providing a signal path connection between each of said effect input connections and all of said effect output connections, said crosspoint switch device also providing a signal path connection between each of said effect output connections and said audio output connection such that signals output by said crosspoint switch device via said audio output connection are selectively receivable from one or more of said effect output connections, each effect input connection being adapted to be coupled to an input of a respective one of the audio effect components and each effect output connection being adapted to be coupled to an output of a respective audio effect component; and a control unit that controls the signal path connections between said audio input connection, said audio output connection, said effect input connections and said effect output connections to enable variations in an audio path from said audio input connection to said audio output connection through said crosspoint switch device, said audio input connection, said audio output connection, said effect input connections and said effect output connections each being configured to receive an audio cable such that said crosspoint switch device connects any one or more of said effect input connections to any one or more of said effect output connections thereby enabling selection of audio effects without adjustment of the audio cables received by said audio input connection, said audio output connection, said effect input connections and said effect output connections.

2. The arrangement of claim 1, wherein said control unit controls the connections between said audio input connection, said audio output connection, said effect input connections and said effect output connections to enable variations in the number and order of the audio effect components interposed in the audio path from said audio input connection to said audio output connection.

3. The arrangement of claim 1, wherein said control unit includes a processor, a memory component coupled to said processor and a user interface coupled to said processor and that enables creation of programs that each control the connections between said audio input connection, said audio output connection, said effect input connections and said effect output connections, the created programs being stored in said memory component and operatively run by said processor.

4. The arrangement of claim 3, wherein said control unit further includes an external network connection coupled to said processor to enable control of said processor from a remote location.

5. The arrangement of claim 3, wherein said user interface includes switches and at least one display.

6. The arrangement of claim 1, wherein said effect input connections and said effect output connections each comprise a port.

7. An arrangement for controlling audio output from an electronic musical instrument, comprising:

a crosspoint switch device having:

an audio input connection adapted to be coupled to the instrument, an audio output connection adapted to be coupled to an audio output component, a plurality of effect input connections, and a plurality of effect output connections, said crosspoint switch device providing a signal path connection between each of said effect input connections and said audio input connection such that signals received by said crosspoint switch device via said audio input connection are selectively directable to one or more of said effect input connections, said crosspoint switch device also providing a signal path connection between each of said effect input connections and all of said effect output connections, said crosspoint switch device also providing a signal path connection between each of said effect output connections and said audio output connection such that signals output by said crosspoint switch device via said audio output connection are selectively receivable from one or more of said effect output connections;

a plurality of audio effect components, each having an input coupled via a respective audio cable to a respective one of said effect input connections and an output coupled via a respective audio cable to a respective one of said effect output connections; and a control unit that controls the signal path connections between said audio input connection, said audio output connection, said effect input connections and said effect output connections to enable one or more of said audio effect components to be interposed in an audio path from said audio input connection to said audio output connection through said crosspoint switch device such that operation of each of said audio effect components, when present in the audio path, varies sound received by said audio input connection of said crosspoint switch device, said audio input connection, said audio output connection, said effect input connections and said effect output connections each being configured to receive an audio cable such that said crosspoint switch device is able to connect any one or more of said effect input connections to any one or more of said effect output connections thereby enabling selection of audio effects without adjustment of the audio cables received by said audio input connection, said audio output connection, said effect input connections and said effect output connections.

8. The arrangement of claim 7, wherein said audio effect components are pedals.

9. The arrangement of claim 7, wherein said control unit controls the connections between said audio input connection, said audio output connection, said effect input connections and said effect output connections to enable variations in the number and order of said audio effect components interposed in the audio path from said audio input connection to said audio output connection.

10. The arrangement of claim 7, wherein said control unit includes a processor, a memory component coupled to said processor and a user interface coupled to said processor and that enables creation of programs that each control the connections between said audio input connection, said audio output connection, said effect input connections and said effect output connections, the created programs being stored in said memory component and operatively run by said processor.

11. The arrangement of claim 10, wherein said control unit further includes an external network connection coupled to said processor to enable control of said processor from a remote location.

12. The arrangement of claim 10, wherein said user interface includes switches and at least one display.

13. The arrangement of claim 7, wherein said effect input connections and said effect output connections each comprise a port.

14. A method for controlling application of audio effect components in an audio path from a musical instrument to an audio output component, comprising:

providing a crosspoint switch device having an audio input connection, an audio output connection, a plurality of effect input connections and a plurality of effect output connections, the crosspoint switch device being configured to provide a signal path connection between each of the effect input connections and the audio input connection such that signals received by the crosspoint switch device via the audio input connection are selectively directable to one or more of the effect input connections, the crosspoint switch device being further configured to provide a signal path connection between each of the effect input connections and all of the effect output connections, the crosspoint switch device being further configured to provide a signal path connection between each of the effect output connections and the audio output connection such that signals output by the crosspoint switch device via the audio output connection are selectively receivable from one or more of the effect output connections;

coupling the audio input connection to the instrument;

coupling the audio output connection to the audio output component;

coupling each effect input connection to an input of a respective one of the audio effect components and each effect output connection to an output of the respective audio effect component;

and controlling the signal path connections between the audio input connection, the audio output connection, the effect input connections and the effect output connections to enable one or more of the audio effect components to be interposed in an audio path from the audio input connection to the audio output connection through the crosspoint switch device such that operation of each of the audio effect components, when present in the audio path, varies sound received by the audio input connection of the crosspoint switch device, the audio input connection, the audio output connection, the effect input connections and the effect output connections each being configured to receive an audio cable such that the crosspoint switch device is able to connect any one or more of the effect input connections to any one or more of the effect output connections thereby enabling selection of audio effects without adjustment of the audio cables received by the audio input connection, the audio output connection, the effect input connections and the effect output connections.

15. The method of claim 14, wherein the connections between the audio input connection, the audio output connection, the effect input connections and the effect output connections are controlled to enable variations in the number and order of the audio effect components interposed in the audio path from the audio input connection to the audio output connection.

16. The method of claim 14, further comprising:

creating programs, using a user interface, for controlling the connections between the audio input connection, the audio output connection, the effect input connections and the effect output connections;

storing the programs in a memory component; and operatively running the programs using a processor.

17. The method of claim 16, further comprising:

controlling, using a control unit, the connections between the audio input connection, the audio output connection, the effect input connections and the effect output connections via a processor; and coupling the processor to an external network connection to thereby enable control of the processor from a remote location.

18. The method of claim 16, further comprising:

controlling, using a control unit, the connections between the audio input connection, the audio output connection, the effect input connections and the effect output connections via a processor;

coupling the processor to an external network connection; and directing processor control commands from a remote location using the external network connection to thereby enable control of the processor from the remote location.

19. The method of claim 16, further comprising:

controlling, using a control unit, the connections between the audio input connection, the audio output connection, the effect input connections and the effect output connections via a processor;

coupling the processor to an external network connection; and directing processor control commands from a remote device at a remote location using the external network connection to thereby enable control of the processor from the remote location.

20. The method of claim 14, wherein the effect input connections and the effect output connections each comprise a port, the audio input connection is coupled to the instrument via a first audio cable, the audio output connection is coupled to the audio output component via a second audio cable, each effect input connection is coupled to an input of a respective one of the audio effect components via a respective audio cable, and each effect output connection is coupled to an output of the respective audio effect component via respective audio cable.

* * * * *